US010886653B2

(12) United States Patent
Martin et al.

(10) Patent No.: US 10,886,653 B2
(45) Date of Patent: Jan. 5, 2021

(54) METHOD AND STRUCTURE FOR CONDUCTIVE ELASTOMERIC PIN ARRAYS USING CONDUCTIVE ELASTOMERIC INTERCONNECTS AND/OR METAL CAPS THROUGH A HOLE OR AN OPENING IN A NON-CONDUCTIVE MEDIUM

(71) Applicants: Charles William Martin, Wind Gap, PA (US); Christopher Matthew Beers, Everett, WA (US); James V. Russell, Basking Ridge, NJ (US)

(72) Inventors: Charles William Martin, Wind Gap, PA (US); Christopher Matthew Beers, Everett, WA (US); James V. Russell, Basking Ridge, NJ (US)

(73) Assignee: R&D Sockets, Inc, Allentown, PA (US)

( * ) Notice: Subject to any disclaimer, the term of this patent is extended or adjusted under 35 U.S.C. 154(b) by 0 days.

(21) Appl. No.: 16/220,710

(22) Filed: Dec. 14, 2018

(65) Prior Publication Data

US 2019/0348787 A1 Nov. 14, 2019

Related U.S. Application Data

(60) Provisional application No. 62/668,540, filed on May 8, 2018.

(51) Int. Cl.
*H01R 13/24* (2006.01)
*H01R 43/00* (2006.01)
(Continued)

(52) U.S. Cl.
CPC ..... *H01R 13/2414* (2013.01); *H01R 12/7082* (2013.01); *H01R 43/007* (2013.01); *H01R 12/52* (2013.01); *H01R 12/523* (2013.01); *H01R 12/57* (2013.01); *H01R 12/62* (2013.01); *H01R 12/714* (2013.01); *H01R 12/73* (2013.01); *H01R 12/79* (2013.01); *H01R 13/24* (2013.01); *H01R 13/2407* (2013.01)

(58) Field of Classification Search
CPC .. H01R 12/714; H01R 12/52; H01R 13/2414; H01R 12/7082; H01R 12/57; H01R 12/62; H01R 13/2407; H01R 12/523; H01R 12/79; H01R 43/007; H01R 12/73; H01R 13/24
USPC ..... 439/66, 91, 591
See application file for complete search history.

(56) References Cited

U.S. PATENT DOCUMENTS 6,062,873 A 5/2000 Kato
7,134,881 B1 * 11/2006 Sakairi ..... H01R 13/2414 439/66

(Continued)

*Primary Examiner* — Adullah A Riyami
*Assistant Examiner* — Justin M Kratt
(74) *Attorney, Agent, or Firm* — Richard B. Klar, Esq.; Law Office Richard B. Klar

(57) ABSTRACT

An improved method and structure is provided for constructing elastomeric pin arrays using a non-conductive medium and compression limiters. Pin to pin of the same elastomeric material, pin to pin of similar elastomeric material, or pin to metal cap structure interconnects are constructed using an elastomeric connection through a non-conductive medium. Compression limiting structures are mated to the non-conductive medium. This structure eliminates the need for PCB structures as the medium reducing manufacturing cost.

7 Claims, 3 Drawing Sheets

Printed Circuit Board to Printed Circuit Board Interconnect

(51) Int. Cl.

| | |
|---|---|
| ***H01R 12/70*** | (2011.01) |
| *H01R 12/52* | (2011.01) |
| *H01R 12/71* | (2011.01) |
| *H01R 12/79* | (2011.01) |
| *H01R 12/57* | (2011.01) |
| *H01R 12/73* | (2011.01) |
| *H01R 12/62* | (2011.01) |

(56) References Cited

U.S. PATENT DOCUMENTS

| | | | | |
|---|---|---|---|---|
| 7,726,984 | B2 | 6/2010 | Bumb, Jr. | |
| 9,049,789 | B2 | 6/2015 | Ohsawa | |
| 9,742,091 | B2 | 8/2017 | Martin | |
| 2004/0110401 | A1* | 6/2004 | DelPrete | H01R 12/52 439/91 |
| 2007/0281516 | A1 | 12/2007 | Yamada | |
| 2008/0239683 | A1* | 10/2008 | Brodsky | H01R 12/52 361/760 |
| 2009/0230975 | A1 | 9/2009 | Yamada | |
| 2011/0223780 | A1 | 9/2011 | Russell | |
| 2012/0202364 | A1 | 8/2012 | Rathburn | |
| 2015/0027749 | A1 | 1/2015 | Warwick | |
| 2015/0295337 | A1* | 10/2015 | Martin | H01R 13/2414 439/91 |

* cited by examiner

Pin to Pin Using Elastomeric Material

Pin to Pin Using Similar Elastomeric Material

Pin to Metal Cap

METHOD AND STRUCTURE FOR CONDUCTIVE ELASTOMERIC PIN ARRAYS USING CONDUCTIVE ELASTOMERIC INTERCONNECTS AND/OR METAL CAPS THROUGH A HOLE OR AN OPENING IN A NON-CONDUCTIVE MEDIUM

CROSS REFERENCE TO RELATED APPLICATIONS

The present application is an improvement for U.S. Pat. No. 9,742,091 B2 filed by the same assignee R&D Sockets, Inc. U.S. Pat. No. 9,742,091 B2 and is incorporated herein as reproduced in its entirety. The present application is a non-provisional application of Provisional Application Ser. No. 62/668,540 filed on May 8, 2018 by R&D Sockets, Inc.

BACKGROUND OF THE INVENTION

1. Field of the Invention

The present invention relates to an improvement for a method and structure for improving conductive elastomeric interposer manufacture. In particular, the present invention provides for improved structure for constructing an elastomeric interposer without a printed circuit board (PCB) substrate. Conductive elastomeric interconnects and/or metal caps are joined together using conductive elastomer structures through a hole in the non-conductive medium. Compression limiting structures are then mated, preferably by adhesive material or by any other known technique in the art to the non-conductive medium. Compression limiting structures, such as but not limited to Kapton, are used to limit conductive elastomeric interconnect compression strokes to within target ranges of 10%-40% of the non-compressed height of the elastomers. This structure forms the electrical interconnect thereby negating the need for a PCB based through a via/pad structure.

2. Description of the Related Art

Typically PCB structures are required as mediums when structuring interconnects. It would be desirable to eliminate the need for PCB structures as mediums thereby reducing manufacturing costs. The present invention accomplishes this by using pin to pin or pin structure interconnects using a conductive elastomer connection through a non-conductive medium. In this way, an elastomeric structure is constructed without a PCB substrate. The conductive elastomer pins or metal caps are connected through one or more holes or openings in the non-conductive medium. This structure forms the electrical interconnect and eliminates the need for a PCB substrate based through via/pad structure.

BRIEF SUMMARY OF THE INVENTION

It would be desirable to provide a method and structure for improving conductive elastomer interposer manufacture. This is accomplished by providing a method and structure for constructing conductive elastomer arrays using a non-conductive medium and conductive elastomer interconnects and/or metal caps.

DETAILED DESCRIPTION OF THE INVENTION

Figure 1:
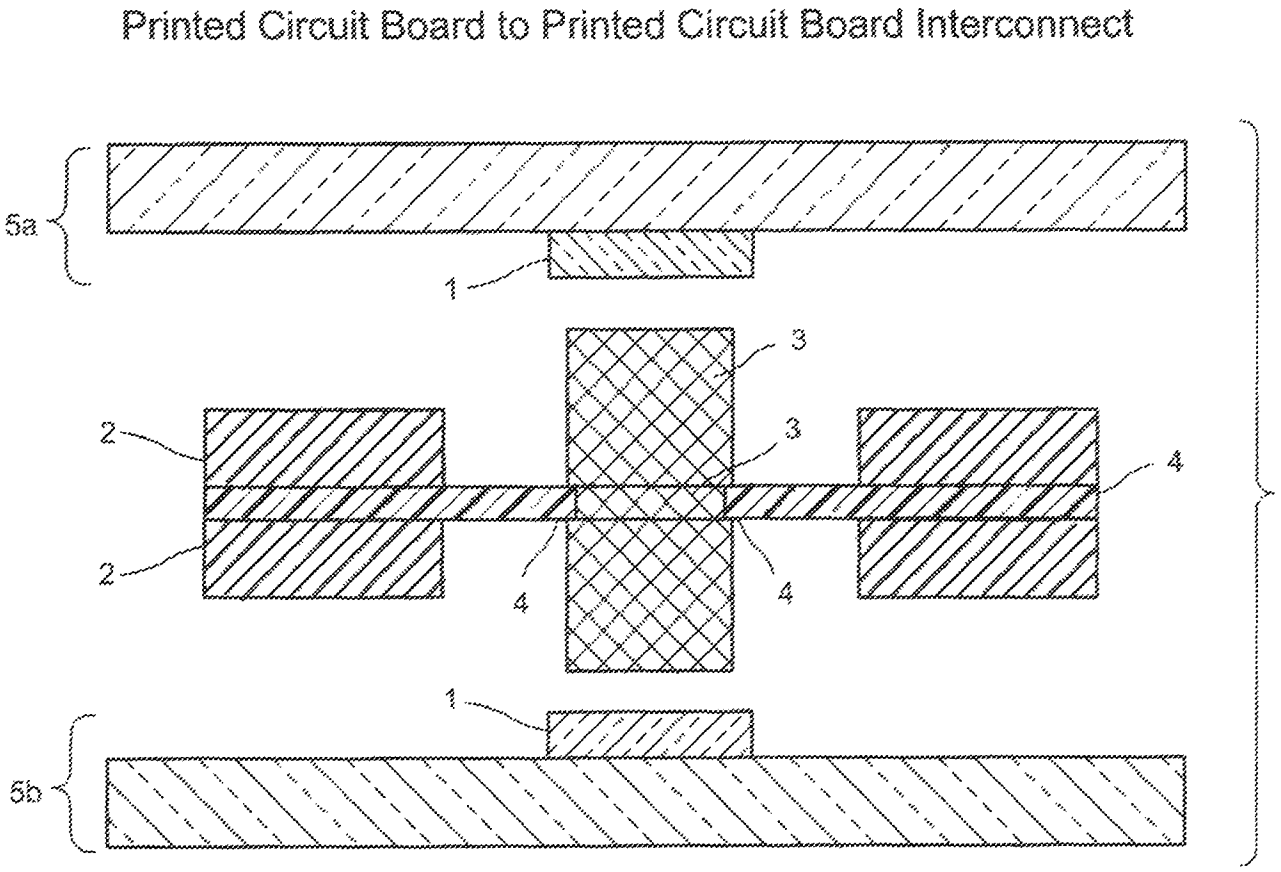
FIG. 1 is a first embodiment showing a PCB to PCB interconnect in accordance with the teachings of the present invention.

Referring to the drawings of FIGS. 1-5, FIG. 1 is a first embodiment of the present invention showing a PCB to PCB interconnect. In FIG. 1, a first PCB structure 5*a* is connected to a second PCB structure 5*b* by a mating pad 1 attached to the portion of the bottom surface of the PCB 5*a* connecting to a top surface of a conductive elastomer 3.

The conductive elastomer 3 is connected with compression limiters 2 on both sides of the conductive elastomer 3 and a non-conductive medium 4 by a non-conductive medium having a hole or opening with elastomeric material and/or metal caps feeding through the hole or opening. A mating pad is provided on a portion of a top surface of the second PCB substrate 5*b* to connectedly be attached, preferably with adhesive material, to the bottom surface of the conductive elastomer 3. FIG. 1 provides an interconnect with no need for solderable metallic disk, e.g. a flange. Thus reducing manufacturing costs.

Figure 2:
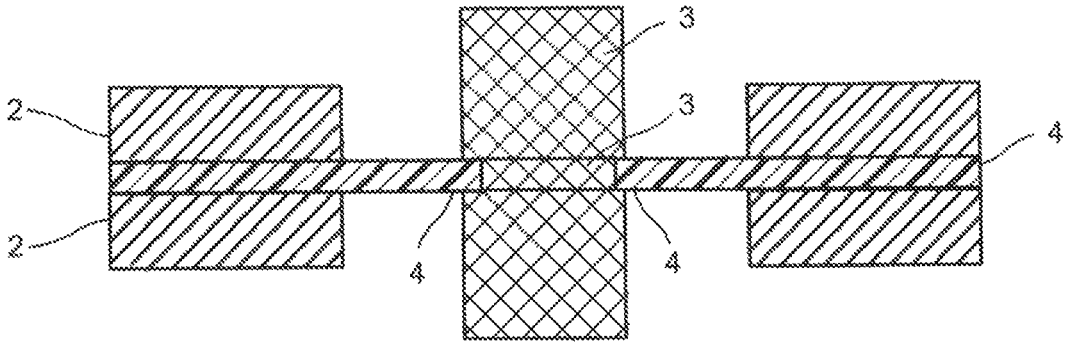
FIG. 2 is a sectional view of a second embodiment of the present invention showing the elastomeric pin connections using the same elastomeric material with a compression limiter and non-conductive medium.

FIG. 2 describes a second embodiment of the present invention in which elastomeric pin connections using the same elastomeric material with a compression limiter and non-conductive medium. Conductive elastomeric interconnects of the same elastomeric material 3 are joined together using conductive structures through a hole in the non-conductive medium 4. Compression limiting structures 2 are used to limit conductive elastomeric interconnect compression strokes to within target ranges. This eliminates the need for a PCB structure and greatly reduces manufacturing cost.

Figure 3:
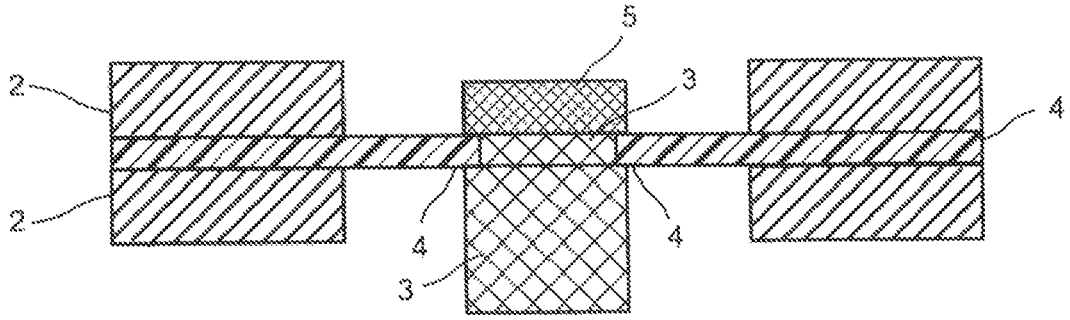
FIG. 3 is a third embodiment of the present invention showing pin to pin connection using similar elastomeric material with a compression limiter, non conductive medium.

FIG. 3 describes a third embodiment of the present invention in which elastomeric pin connections using the similar elastomeric material 3, 5 with a compression limiter 2 and non-conductive medium 4. Conductive elastomeric interconnects of the similar elastomeric material 3, 5 are joined together using conductive structures through a hole in the non-conductive medium 4. Compression limiting structures 2 are used to limit conductive elastomeric interconnect compression strokes to within target ranges. This eliminates the need for a PCB structure and greatly reduces manufacturing cost.

Figure 4:
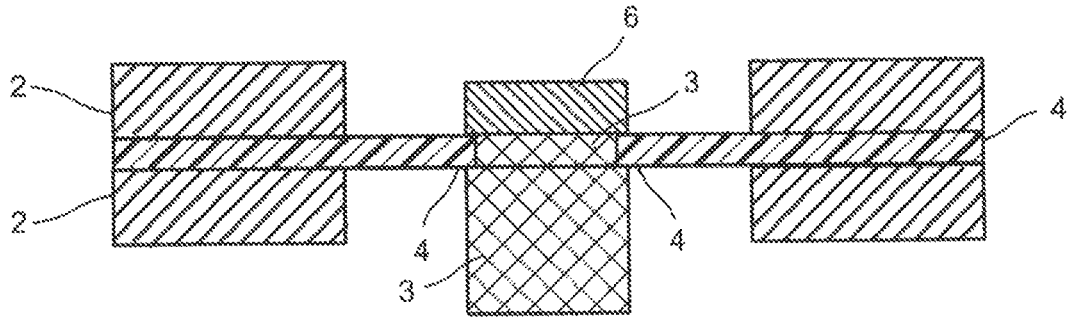
FIG. 4 is a fourth embodiment of the present invention showing pin to metal cap connection using a compression limiter, a non-conductive medium and a metal cap.

FIG. 4 is a fourth embodiment of the present invention showing elastomeric pin 3 to metal cap 6 connection using a compression limiter 2, a non-conductive medium 4 and a metal cap 6. Conductive elastomeric interconnects 3 and metal caps 6 are joined together using conductive structures through a hole in the non-conductive medium 4. Compression limiting structures 2 use the metal 6 to non-conductive medium 4.

Figure 5:
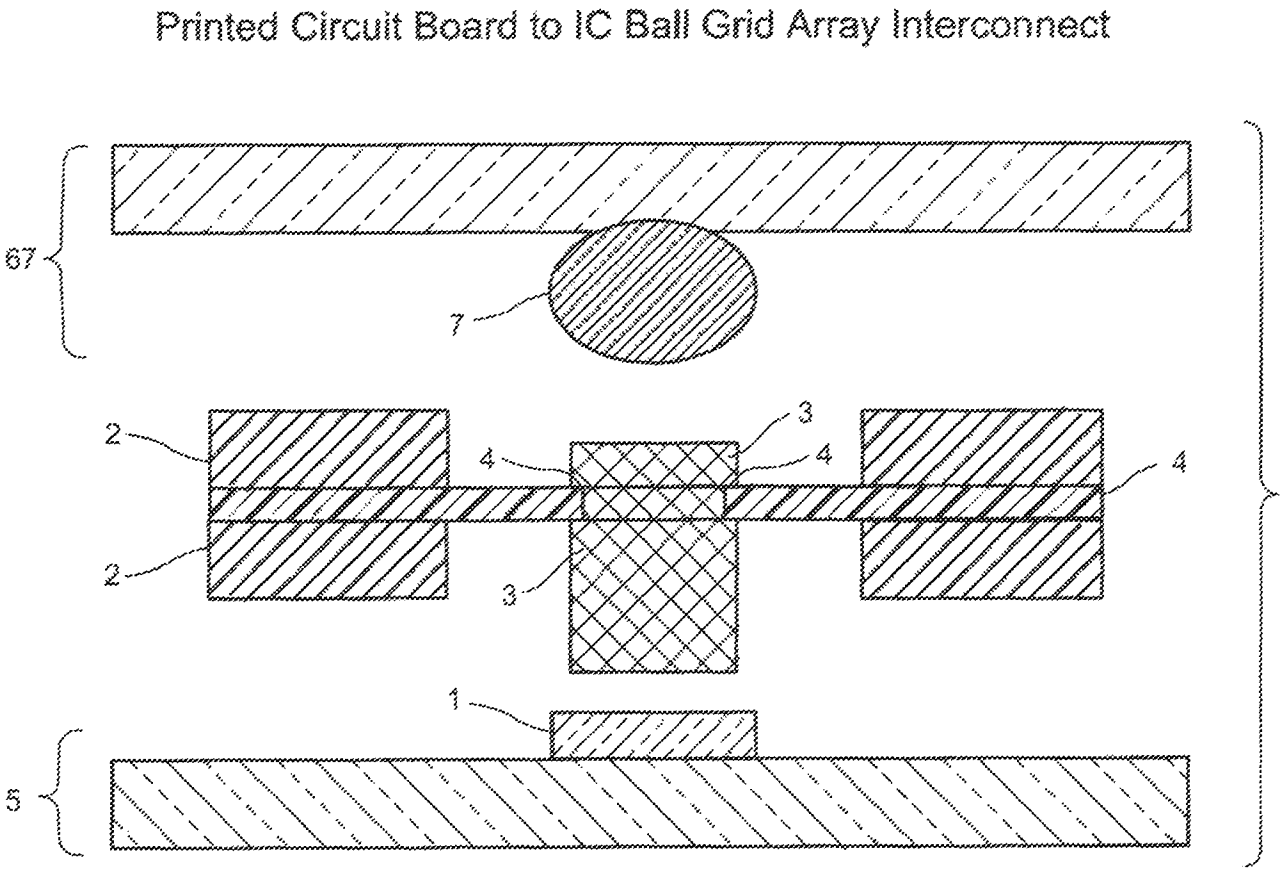
FIG. 5 is a fifth embodiment of the present invention showing a PCB to IC ball grid array interconnect using a mating pad, a compression limiter, a conductive elastomer, a non-conductive medium and a ball.

FIG. 5 is a fifth embodiment of the present invention showing a PCB 5 connected to an IC ball grid array interconnect 67 using a mating pad 1, a compression limiter 2, a conductive elastomer 3 and a non-conductive medium 4 and a ball 7. The ball grid array 6 is connected to the structure formed with compression limiter structures 2 connected by feeding through a hole or an opening in a non-conductive medium 4 with a conductive elastomer and/or metal caps. A bottom portion of the elastomer 3 is mated, preferably by adhesive material, to a mating pad 1 attached to a top portion of the PCB structure 5. This is a less costly process to manufacture as solderable metallic material is not needed to form this interconnect structure.

While certain embodiments have been shown and described, it is distinctly understood that the invention is not limited thereto but may be otherwise embodied within the scope of the appended claims.

What is claimed:

1. An electrical interconnect, comprising:

elastomeric pin arrays of either isolated pins or connected pins formed of elastomeric material joined together using a conductive elastomer placed in a hole or opening in a non-conductive medium; and compression limiting structures mated to said non-conductive medium, said compression limiting structures being used to limit conductive elastomeric strokes to within target ranges that are 10%-40% of the non-compressed height of said elastomer thereby forming an electrical interconnect and negating a need for a Printed Circuit Board (PCB) based through via/pad structure and reducing manufacturing costs.

2. The electrical interconnect of claim 1 wherein said elastomers are the same elastomeric material.

3. The electrical interconnect of claim 1 wherein said elastomers are a similar elastomeric material.

4. The electrical interconnect of claim 1 wherein said compression limiting structures, such as but not limited to Kapton, are used to limit conductive elastomeric interconnect compression strokes to within target ranges of 10%-40% of the non-compressed height of the elastomers.

5. A method for forming an electrical interconnect, the steps comprising: forming elastomeric pin arrays of elastomeric material joined together using a conductive elastomer through a hole or opening in a non-conductive medium; and compression limiting structures mated to said non-conductive medium, said compression limiting structures limiting conductive elastomeric strokes to within a target range of 10%-40% of the non-compressed height of said elastomer thereby forming an electrical interconnect and negating a need for a Printed Circuit Board (PCB) based through via/pad structure and reducing manufacturing costs.

6. The method of claim 5 wherein said elastomers are the same elastomeric material.

7. The method of claim 5 wherein said elastomers are a similar elastomeric material.

* * * * *